US005570105A

United States Patent [19]

Koyama

[11] Patent Number: 5,570,105

[45] Date of Patent: Oct. 29, 1996

[54] DRIVING CIRCUIT FOR DRIVING LIQUID CRYSTAL DISPLAY DEVICE

[75] Inventor: Jun Koyama, Kanagawa, Japan

[73] Assignee: Semiconductor Energy Laboratory Co., Ltd., Kanagawa-ken, Japan

[21] Appl. No.: 361,034

[22] Filed: Dec. 21, 1994

[30] Foreign Application Priority Data

Dec. 25, 1993 [JP] Japan ..... 5-347674
Dec. 25, 1993 [JP] Japan ..... 5-347675

[51] Int. Cl.[6] ..... G09G 3/36

[52] U.S. Cl. ..... 345/98; 345/92; 345/100; 345/147

[58] Field of Search ..... 345/92, 98, 100, 345/147

[56] References Cited

U.S. PATENT DOCUMENTS 5,477,234 12/1995 Suzuki et al. ..... 345/98

*Primary Examiner*—Richard Hjerpe
*Assistant Examiner*—Vui Tran
*Attorney, Agent, or Firm*—Sixbey, Friedman, Leedom & Ferguson, P.C.; Gerald J. Ferguson, Jr.

[57] ABSTRACT

In a sampling circuit for a driving circuit for driving an active matrix circuit having signal lines in an active matrix type liquid crystal display device, two switches are connected with each other in series. Further a connection point between two switches is connected with a constant voltage input terminal through another switch or a resistor, to reduce a voltage applied to the TFTs constructing two switches and to perform at high speed operation in the TFTs. When sampling is not performed, the two switches are turned off and a constant voltage is applied from the constant voltage input terminal to the connection point.

24 Claims, 11 Drawing Sheets

DRIVING CIRCUIT FOR DRIVING LIQUID CRYSTAL DISPLAY DEVICE

BACKGROUND OF THE INVENTION

1. Field of the Invention

This invention relates to a driving circuit for driving a liquid crystal display device, in particular, a signal line driving circuit.

2. Description of the Related Art

FIG. 2 shows an example of an active matrix type liquid crystal display device in which analog gradation lines are driven sequentially. The active matrix type liquid crystal display device includes a pixel matrix portion 200, a signal line driving circuit 240 and a scanning line driving circuit 250.

In the pixel matrix portion 200, signal lines 201 to 203 and scanning lines 204 to 206 are arranged at a matrix form. Pixel thin film transistors (TFTs) 207 to 210 are arranged in intersection portions of the signal lines and the scanning lines. In each of the TFTs 207 to 210, a gate, a source and a drain are connected with the scanning line, the signal line and a pixel electrode, respectively. In general, since a capacitance of liquid crystals 211 to 214 arranged between the pixel electrodes and opposite electrodes cannot have a large value, storage capacitors 215 to 218 for storing charges are arranged in vicinity of the pixel electrodes.

When a voltage higher than a threshold voltage of the TFT is applied to the scanning line and the TFT is turned on, the drain and the source in the TFT are in a short circuit state. When a voltage on the signal line is applied to the pixel electrode, the liquid crystal and the storage capacitor are charged. On the other hand, when the TFT is turned off, since the drain and the source is in an open circuit state, charges in the liquid crystal and the storage capacitor are stored until the TFT is turned on.

FIG. 3 shows an example of the signal line driving circuit 240. The signal line driving circuit 240 includes a shift register circuit 350, a buffer circuit 351, a sampling circuit 352, a transfer circuit 354 and an analog buffer circuit 353. The shift register circuit 350 has flip-flops (F/Fs) 330 to 332. The buffer circuit 351 has invertor type buffers 308 to 313. The sampling circuit 352 has switches 314 to 316 and storage capacitors 317 to 319. The transfer circuit 354 has switches 320 to 322. The analog buffer circuit 353 has analog buffers 340 to 342 and storage capacitors 323 to 325.

In an analog gradation, a continuous video signal is used as a gradation signal input to the signal line driving circuit 240. When a liquid crystal is a normal white mode, it is set that a display portion of the liquid crystal display device approaches black in accordance with increase of an absolute value of a voltage applied to the liquid crystal. The video signal is input from a video signal input terminal 303. A start pulse signal which synchronizes the video signal is input from a start pulse signal input terminal 302 to a flip-flop 330 of the shift register circuit 350, and then the shift register circuit 350 is shift-operated in response to a clock pulse signal input from a clock pulse signal input terminal 301. An output of the flip-flop 330 of the shift register circuit 350 is input to the switch 314 of the sampling circuit 352 through the buffers 308 and 309 of the buffer circuit 351.

FIG. 4 shows an example of a transmission gate in which an N-channel TFT and a P-channel TFT are combined. The transmission gate includes a control terminal 401, an input terminal 402, an output terminal 403, an N-channel TFT 405 and a P-channel TFT 404. In FIG. 4, the input terminal 402 is electrically connected with the video signal line 360 and the output terminal 403 is electrically connected with the capacitor 317 or the like. Each of the switches 314 to 316 in the sampling circuit 352 is constructed by the transmission gate. The transmission gate is turned on/off by the buffer circuit 351 through the control terminal 401.

When the switch 314 is turned on, the video signal line 360 is electrically connected with the storage capacitors 317 to 319 of the sampling circuit 352 to store charges in the capacitors 317 to 319. When the start pulse signal passes through the flip-flop 330, an output of the flip-flop 330 is reversed, the switch 314 is turned off.

Since charges are stored in the storage capacitor 317, a voltage is stored until the switch 314 is turned on. After sampling of one line is completed, a transfer signal is input from a transfer signal input terminal 304 before next sampling is started. Therefore, the switches 320 to 322 of the transfer circuit 354 are turned on, the storage capacitors 317 to 319 are electrically connected with the storage capacitors 323 to 325 of the analog buffer circuit 353 to store a voltage in the capacitors 323 to 325.

When a capacitance value of the capacitors 323 to 325 is sufficiently smaller than that of the capacitors 317 to 319 and when the capacitors 317 to 319 and the capacitors 323 to 325 are in a short circuit state, change of the voltage is small. When the switches 320 to 322 are turned off, the voltage is stored in the storage capacitors 323 to 325.

The analog buffers 340 to 342 of the analog buffer circuit 353 are connected with the storage capacitors 323 to 325 to drive the signal lines through the analog buffers 340 to 342. The analog buffer circuit 353 is necessary to drive the signal lines without influencing the voltage of the storage capacitor.

FIGS. 5A shows an example of the scanning line driving circuit 250. The scanning line driving circuit 250 includes clocked invertor used circuits 510 to 512 (as shown in FIGS. 5B), NAND circuits 503 and 504 and invertor type buffers 505 and 506. The clocked invertor used circuit includes clocked invertors 520 and 521 operated by a clock signal CK (as shown in FIG. 5C) and an invertor 522. The start pulse signal which synchronizes a vertical synchronizing signal is input from a start pulse signal input terminal 502, and the clock pulse signal which synchronizes a horizontal synchronizing signal is input from a clock pulse signal input terminal 501. Therefore, the scanning lines are driven sequentially through scanning line connection terminals 507 and 508.

In a conventional signal line driving circuit, as described above, an analog switch such as the transmission gate is used in a sampling circuit. It is necessary to operate the sampling circuit at high speed. Also, it is desired that a TFT to be used has performances such as high mobility and a small capacity. However, these characteristics contrast with a characteristic such as a withstanding voltage of the TFT. That is, if the withstanding voltage is improved, since a high speed performance deteriorates, the TFT cannot be operated at high speed.

FIG. 6 shows a conventional sampling circuit. The sampling circuit includes a switch 601, a storage capacitor 602, a gradation signal input terminal 603, a storage capacitor connection terminal 604, and a control signal input terminal 605. FIGS. 7A to 7C show voltage waveforms in the gradation signal input terminal 603, the storage capacitor connection terminal 604 and the control signal input terminal 605, respectively. If a direct current (DC) voltage is applied to a liquid crystal for a long period of time, a characteristic of the liquid crystal deteriorates. Therefore, an alternating current (AC) voltage as shown in FIG. 7A is applied to the liquid crystal.

The AC voltage having 14 V (peak to peak) is applied from the gradation signal input terminal 603. A pulse signal as shown in FIG. 7C is applied to the control signal input terminal 605. When the pulse signal is high, sampling is performed and the AC voltage is applied to the storage capacitor 602. When the pulse signal is low, the switch 601 is opened and charges are stored in the storage capacitor 602 until next sampling is started. Since a voltage having the same amplitude as the AC voltage may be applied between the gradation signal input terminal 603 and the storage capacitor connection terminal 604, it is required that the TFT constructing the switch 601 withstands the AC voltage, thereby to deteriorate a high speed performance.

SUMMARY OF THE INVENTION

An object of the present invention is to solve the above problems.

According to the present invention, there is provided a driving circuit for driving an active matrix circuit which is constructed by thin film transistors and has signal lines in a liquid crystal display device, the driving circuit comprising: sampling circuit for sampling a gradation signal to be supplied to the signal line, wherein the sampling circuit comprises, a constant voltage terminal which a constant voltage is supplied to, a first switch which the gradation signal is supplied to,a second switch having two ends, wherein one end is connected with the first switch in series and the other end is connected with the signal line, and a third switch having two ends, wherein one end is connected with a connection point between the first and second switches and the other end is connected with the constant voltage terminal.

According to the present invention, there is provided a driving circuit for driving an active matrix circuit which is constructed by thin film transistors and has signal lines in a liquid crystal display device, the driving circuit comprising: sampling circuit for sampling a gradation signal to be supplied to the signal line, wherein the sampling circuit comprises, a constant voltage terminal which a constant voltage is supplied to, a first switch which the gradation signal is supplied to, a second switch having two ends, wherein one end is connected with the first switch in series and the other end is connected with the signal line, and a resistor having both ends, wherein one end is connected with a connection point between the first and second switches and the other end is connected with the constant voltage terminal.

DETAILED DESCRIPTION OF THE PREFERRED EMBODIMENTS

In a sapling (or selecting) circuit of the present invention, two switches are connected with each other in series, and a connection point is connected with a desired (constant) voltage terminal through another switch or a resistor. The switches each has, for example, a transmission gate and is constructed by thin film transistors (TFTs).

Figure 8:
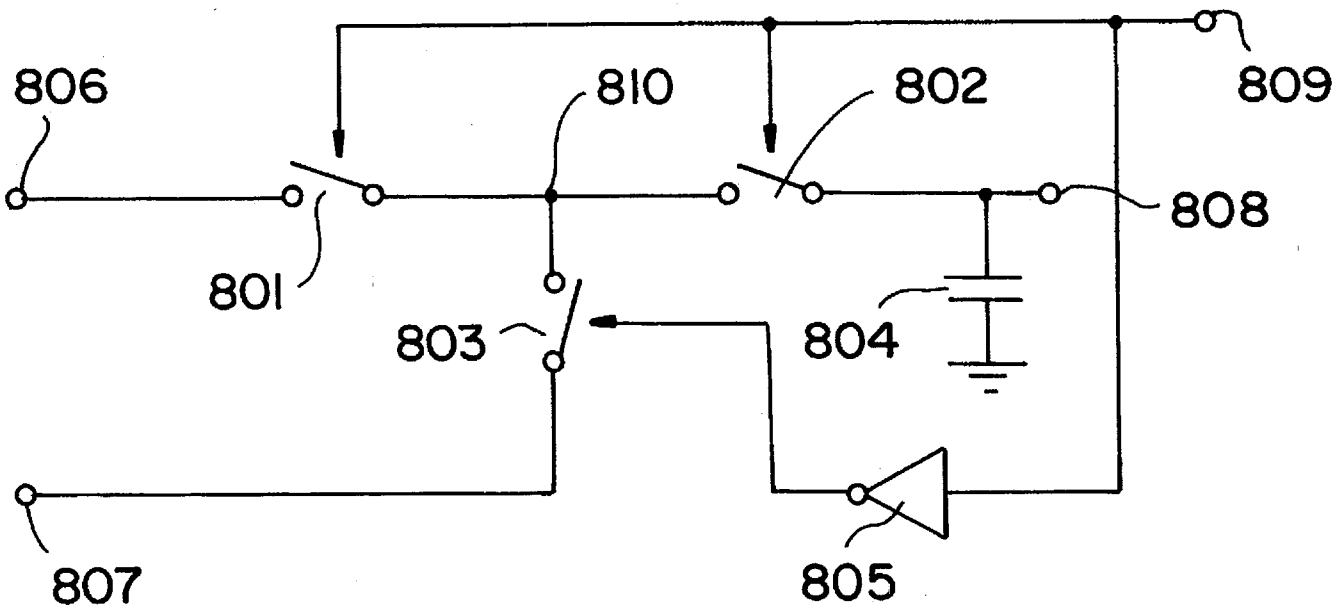
FIG. 8 is a first concept view of a sampling circuit according to the present invention.

FIG. 8 is a first concept view of a sampling circuit according to the present invention. The sampling circuit includes switches 801 to 803, a storage capacitor 804, an invertor 805, a gradation signal input terminal 806, a constant voltage input terminal 807, a storage capacitor connection terminal 808, and a control signal input terminal 809. When sampling is performed, the switches 801 and 802 are turned on simultaneously in response to a control signal from the terminal 809 and a voltage on the gradation signal input terminal 806 coincides with that on the storage capacitor connection terminal 808, so that a gradation signal is applied to the storage capacitor 804.

Figure 7A:
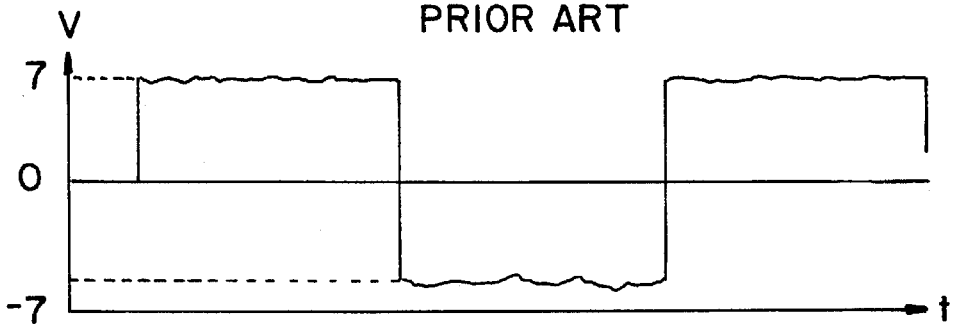
FIG.7A PRIOR ART
FIGS. 7A to 7C show voltage waveforms in the gradation signal input terminal, the storage capacitor connection terminal and the control signal input terminal, respectively.
Figure 7B:
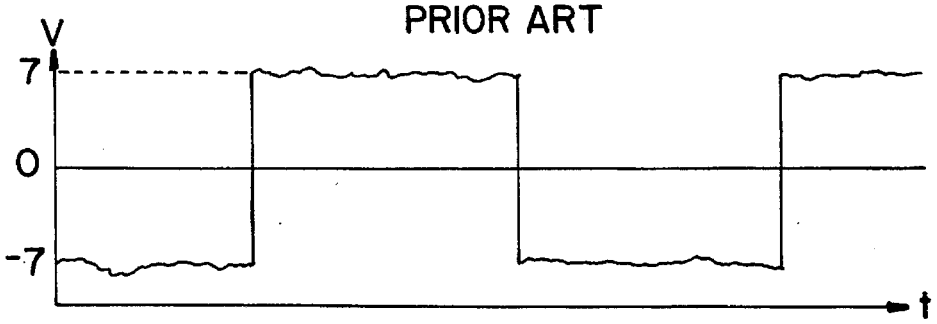
FIG.7B PRIOR ART
Figure 7C:
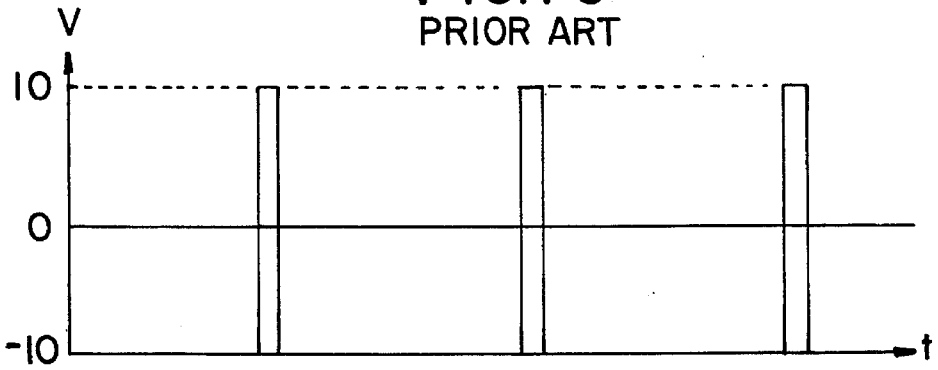
FIG.7C PRIOR ART

When sampling is not performed, the switches 801 and 802 are turned off and the switch 803 is turned on. Since the switch 802 is opened, the storage capacitor 804 stores charges until next sampling is started. Also, since the switch 803 is connected with the constant voltage input terminal 807, a voltage on a connection point 810 coincides with that on the terminal 807. When it is set so as to coincide the voltage on the terminal 807 with a voltage on an opposite electrode used to apply a voltage to a liquid crystal and when the AC voltage as shown in FIG. 7A is applied, a voltage applied to the switches 801 and 802 can be half of an amplitude of the AC voltage, i.e. 7 V.

Figure 1:
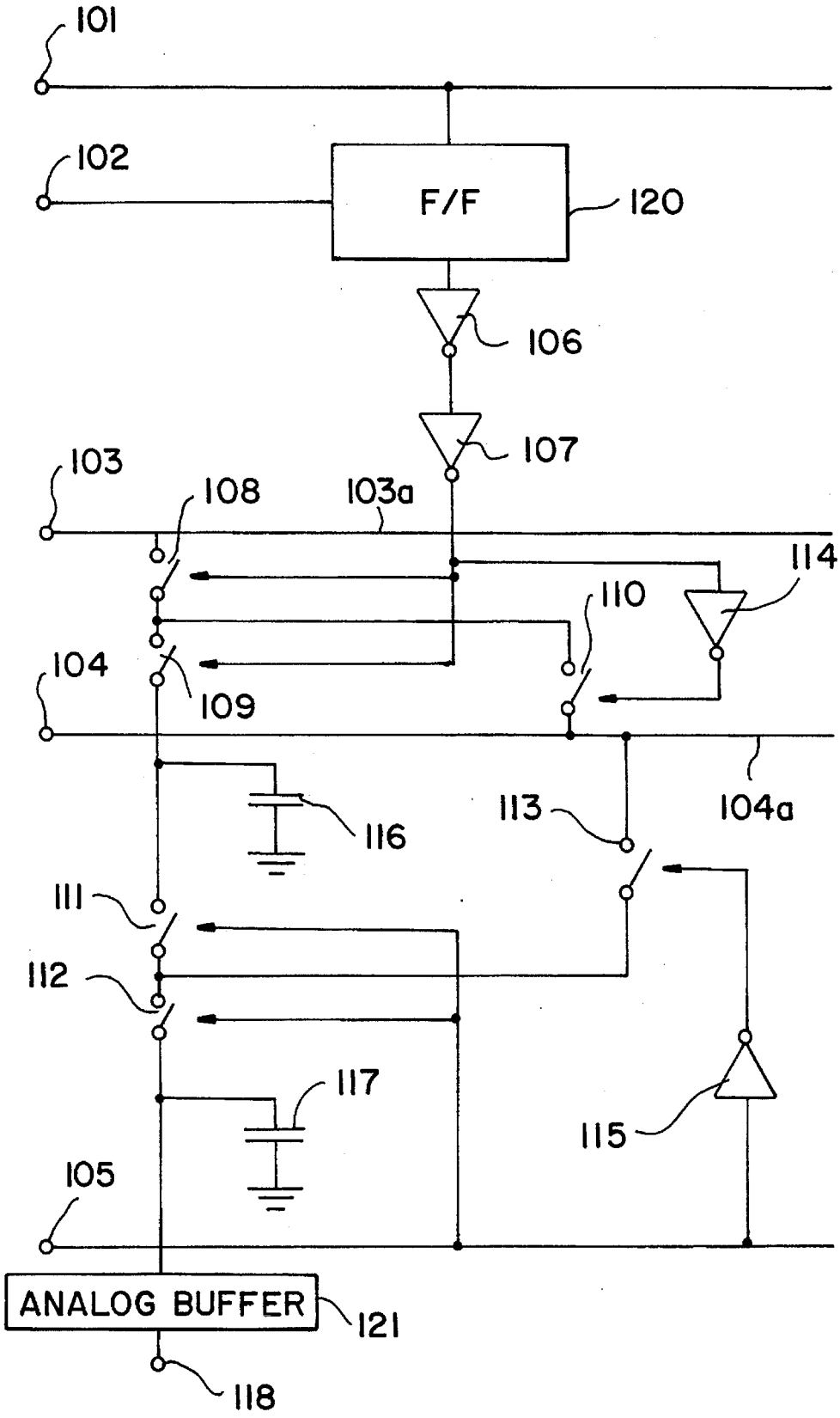
FIG. 1 shows a sampling circuit of a signal line driving circuit according to an embodiment of the present invention.
Figure 2:
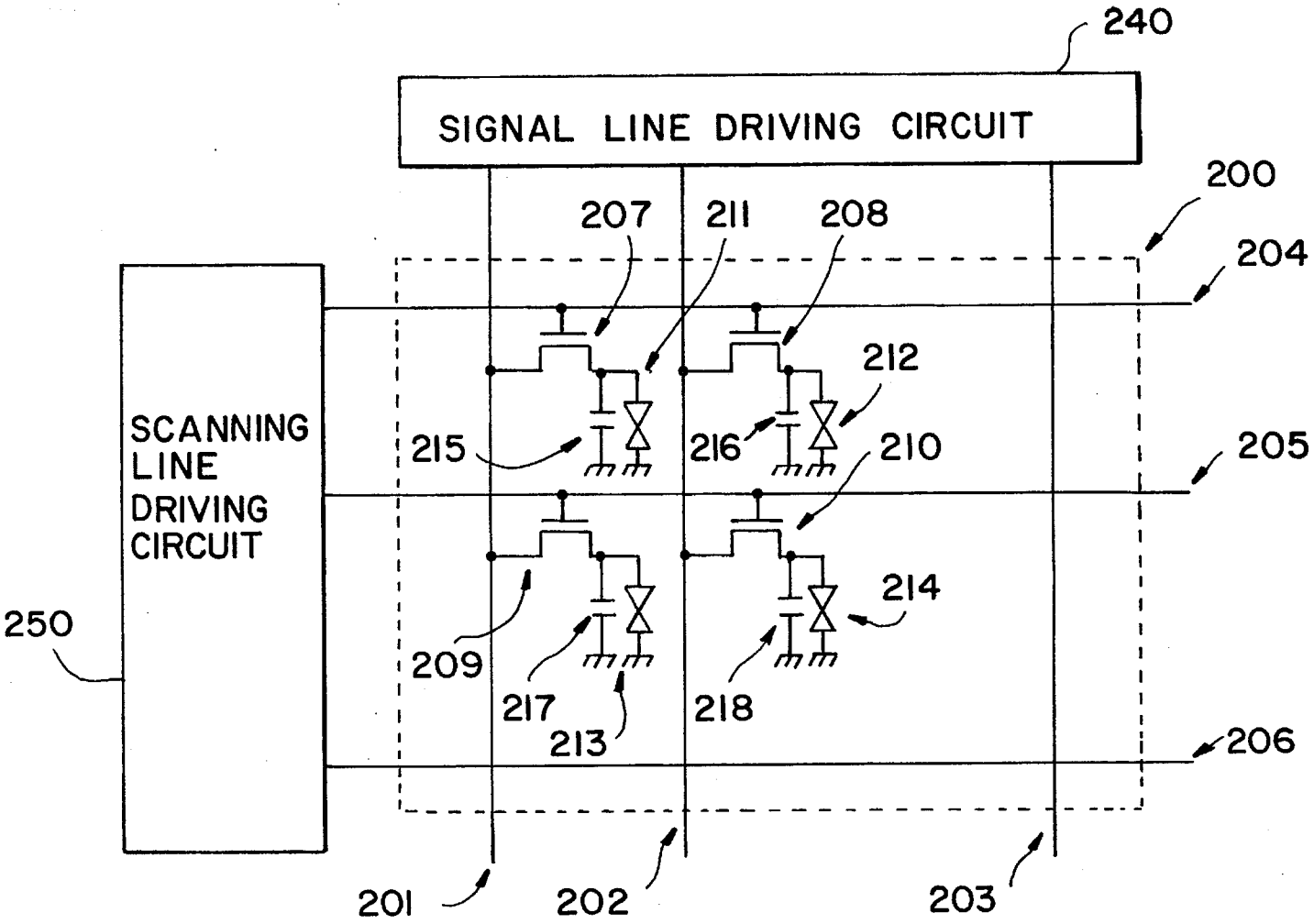
FIG. 2 PRIOR ART
FIG. 2 shows an active matrix type liquid crystal display device in which analog gradation lines are driven sequentially.
Figure 3:
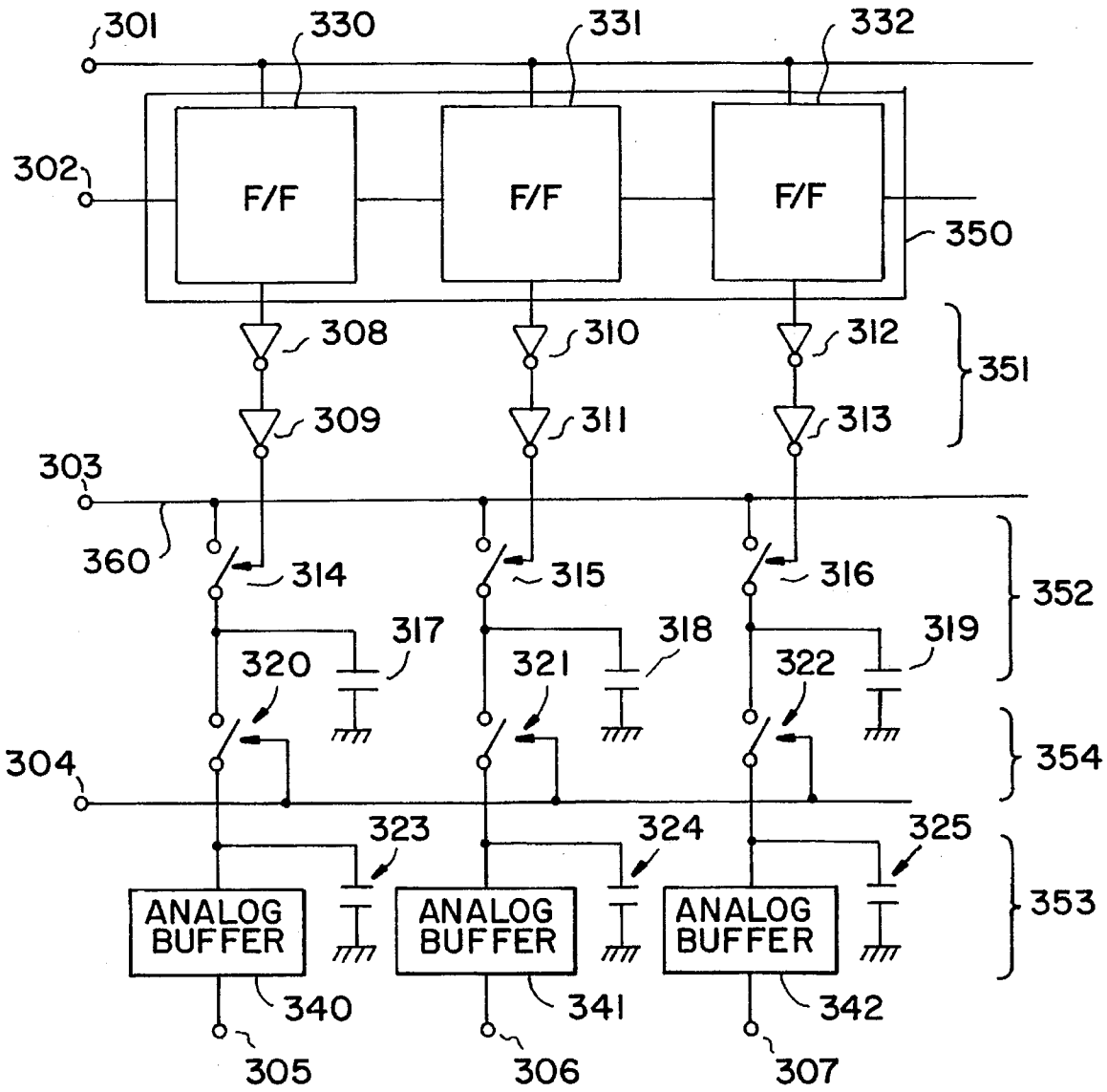
FIG. 3 PRIOR ART
FIG. 3 shows a signal line driving circuit.
Figure 4:
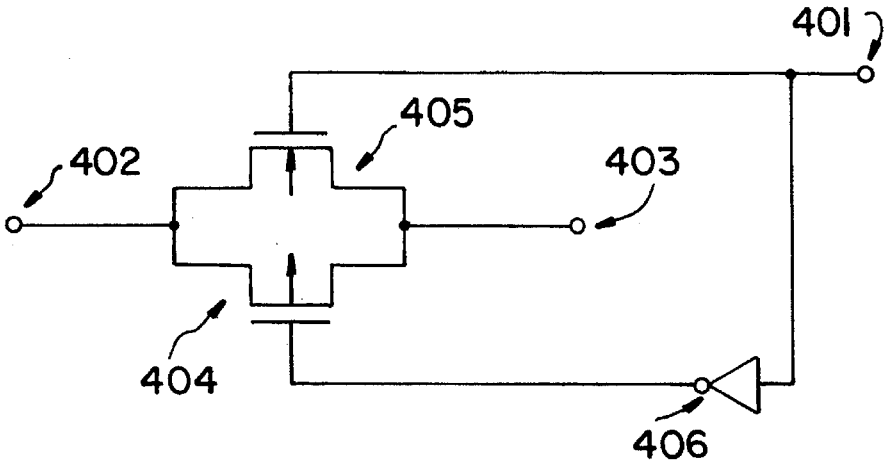
FIG. 4 PRIOR ART
FIG. 4 shows a transmission gate.
Figure 5A:
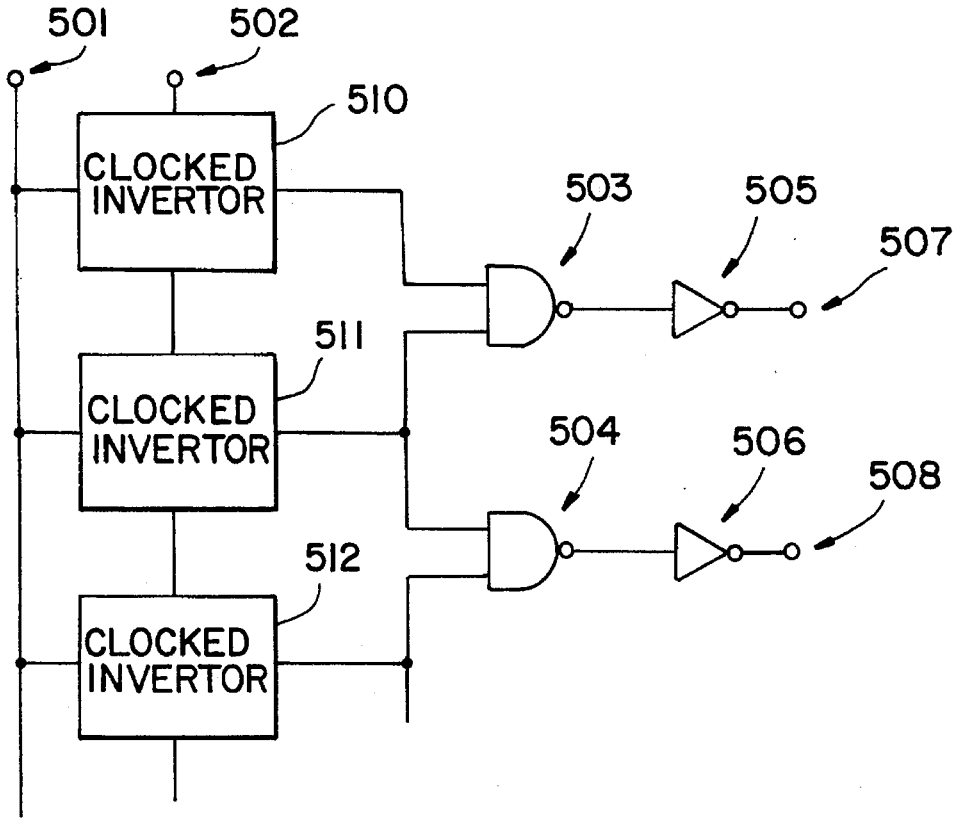
FIG. 5A PRIOR ART
FIGS. 5A to 5C show a scanning line driving circuit.
Figure 5B:
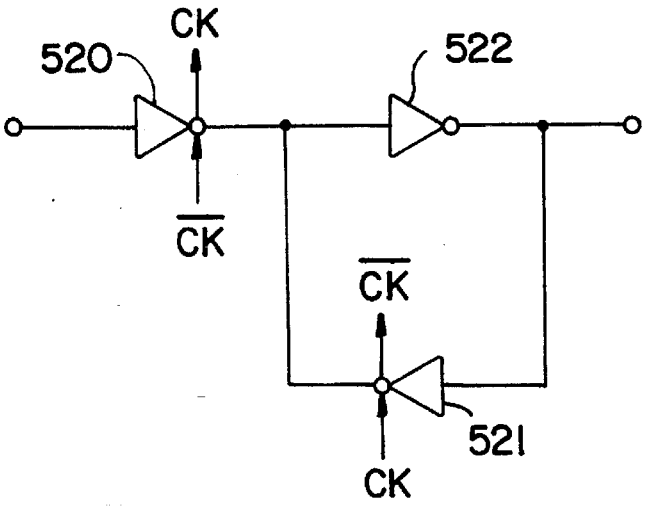
FIG. 5B PRIOR ART
Figure 5C:
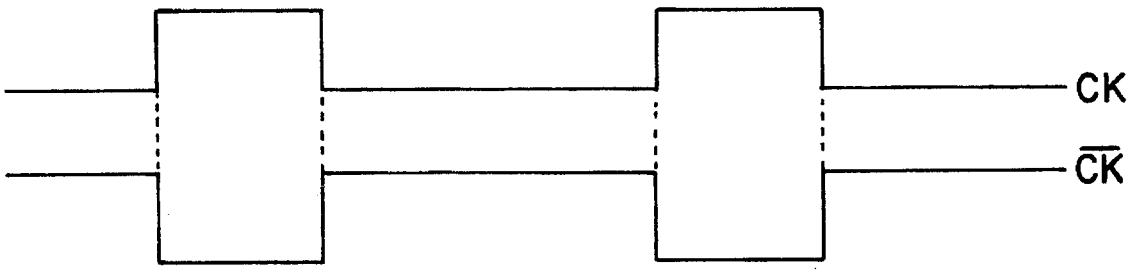
FIG. 5C PRIOR ART
Figure 6:
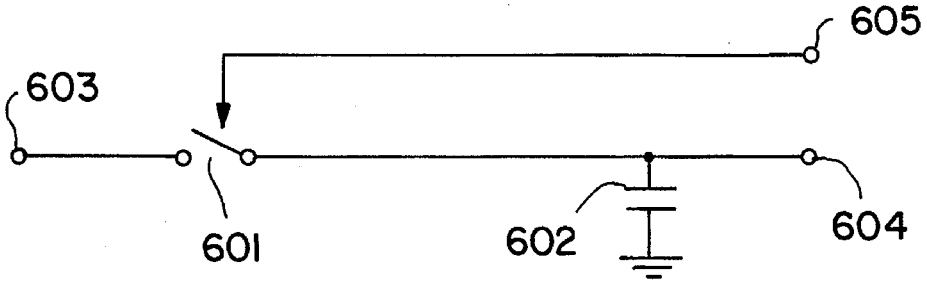
FIG.6 PRIOR ART
FIG. 6 shows a conventional sampling circuit.

FIG. 1 shows a sampling circuit of a signal line driving circuit according to an embodiment of the present invention. The sampling circuit includes a clock pulse signal input terminal 101, a start pulse signal input terminal 102, a video signal (gradation signal) input terminal 103, a constant voltage input terminal 104, transfer signal input terminal 105, invertor type buffers 106, 107, 114 and 115, switches 108 to 113, storage capacitors 116 and 117, a signal line connection terminal 118, a flip-flop (F/F) 120, and an analog buffer 121.

When sampling is performed, the switches 108 and 109 are turned on in accordance with output of the invertor type buffer 107 and a voltage on the video signal (gradation signal) line 103*a* is stored in the storage capacitor 116. When sampling is not performed, the switches 108 and 109 are turned off and the switch 110 is turned on. Since the switch 110 is connected with a constant voltage line 104*a*, a voltage on a connection point connecting the switch 108 with the switch 109 coincides with that on the constant voltage line 104*a*. If a voltage on the line 104*a* is a voltage on an opposite electrode used for voltage application to a liquid crystal, the voltage applied to the switches 108 and 109 can be half of an amplitude of a video signal (gradation signal) on the video signal line 103*a*. Also, a voltage applied to the switches 111 and 112 of the transfer circuit can be reduced.

Figure 9:
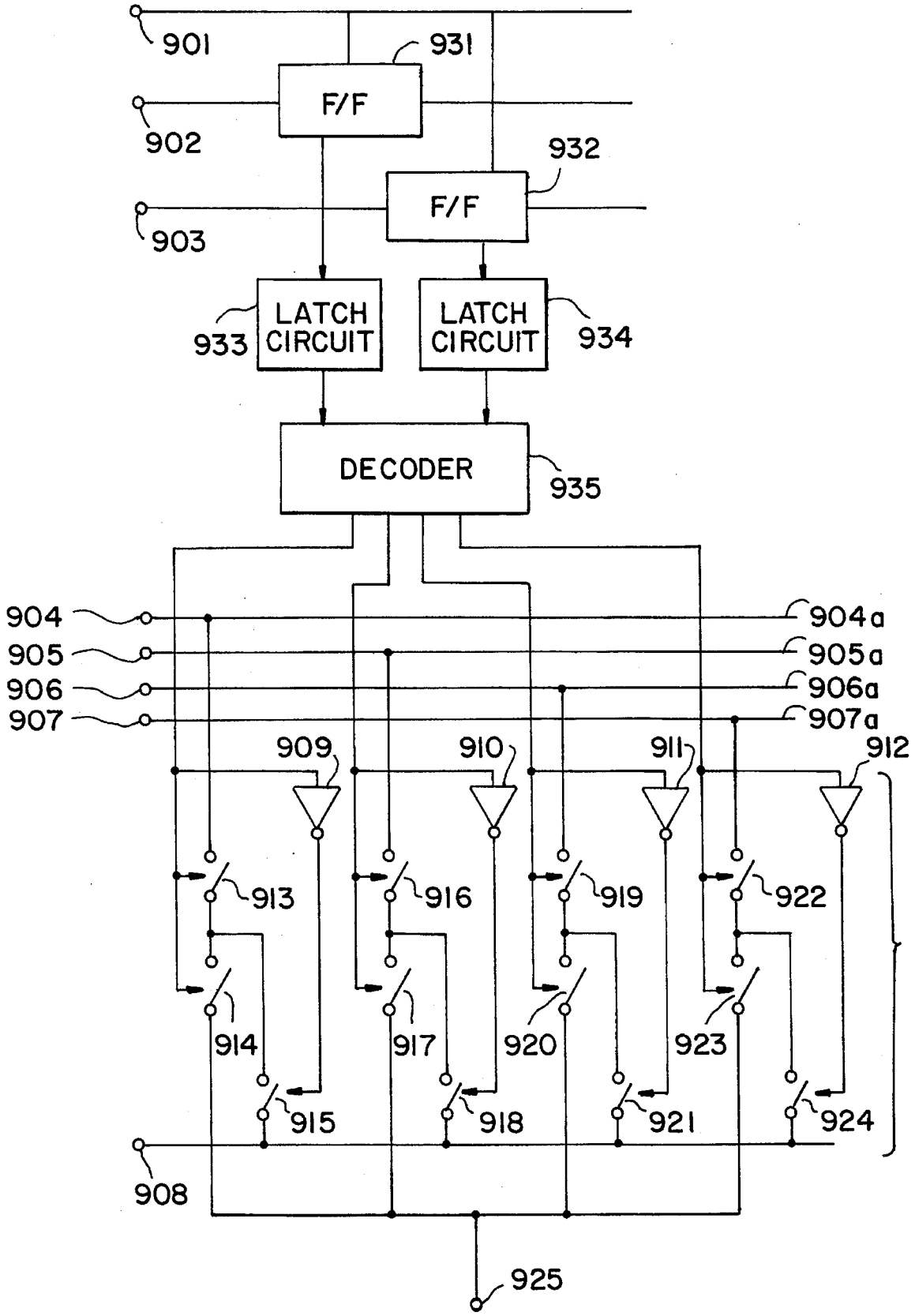
FIG. 9 shows a gradation voltage signal selecting circuit for a signal line driving circuit of 4 digital gradations according to another embodiment of the present invention.

FIG. 9 shows a gradation (voltage) signal selecting circuit for a signal line driving circuit of 4 digital gradations according to another embodiment of the present invention. The digital gradation type signal line driving circuit includes a clock pulse signal input terminal 901, start pulse signal input terminals 902 and 903, gradation signal input terminals 904 to 907, gradation signal (voltage) lines 904*a*, 905*a*, 906*a* and 907*a*, a constant voltage input terminal 908, invertors 909 to 912, a switching circuit 930 constructed by switches 913 to 924, a signal line output terminal 925, flip-flops (F/Fs) 931 and 932, latch circuits 933 and 934, and a decoder 935.

The switching circuit 930 selects one of the gradation signal lines 904*a*, 905*a*, 906*a* and 907*a* to connect the selected gradation signal line with the signal line output terminal 925. When the gradation signal line 904*a* is selected, the switches 913, 914, 918, 921 and 924 are turned on and the switches 915 to 917, 919, 920, 922 and 923 are turned off. If a voltage on the constant voltage input terminal 908 is set to a desired voltage capable of supplying to the gradation voltage lines 904*a*, 905*a*, 906*a* and 907*a*, a voltage applied to both ends of each of the switches 916, 917, 919, 920, 922 and 923 can be reduced.

Figure 11:
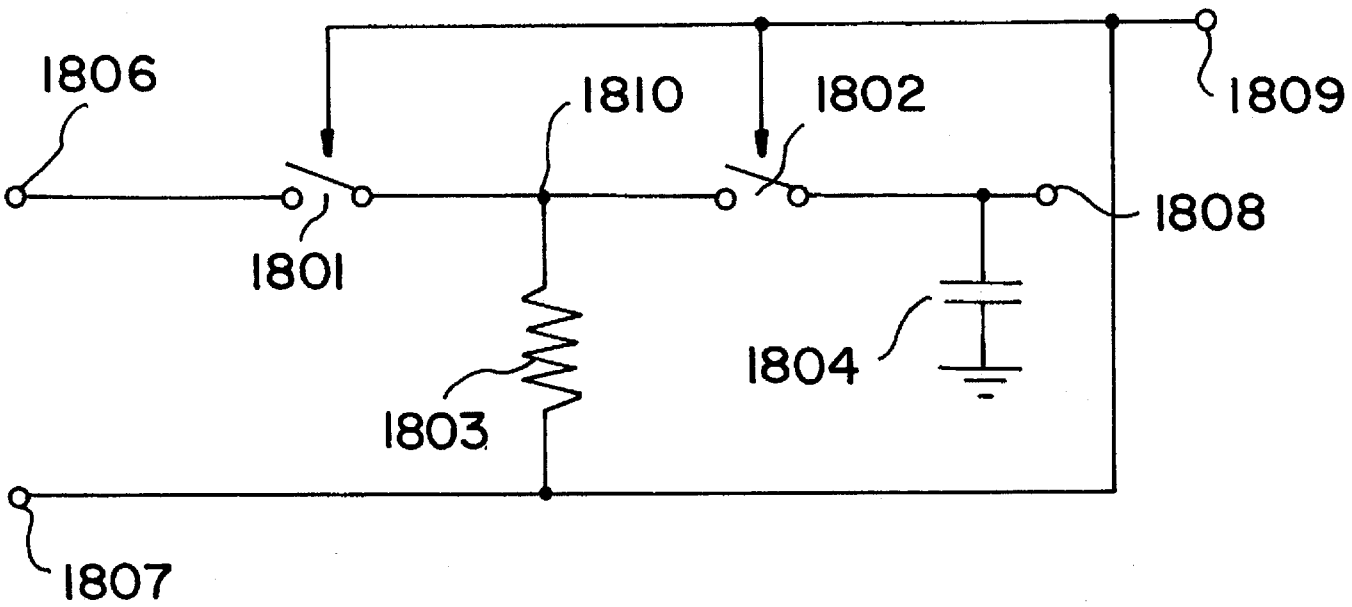
FIG. 11 is a second concept view of a sampling circuit according to the present invention.

FIG. 11 is a second concept view of a sampling circuit according to the present invention. The sampling circuit includes switches 1801 and 1802, a resistor 1803, a storage capacitor 1804, a gradation signal input terminal 1806, a constant voltage input terminal 1807, a storage capacitor connection terminal 1808, and a control signal input terminal 1809. When sampling is performed, the switches 1801 and 1802 are turned on simultaneously. If an on-resistance value of the switch 1801 is sufficiently smaller that a resistance value of the resistor 1803, a voltage on the gradation signal input terminal 1806 coincides with that on the storage capacitor connection terminal 1808, so that a gradation signal is applied to the storage capacitor 1804.

When sampling is not performed, the switches 1801 and 1802 are turned off. Since the switch 1802 is opened, the storage capacitor 1804 stores charges until next sapling is started. Also, since the resistor 1803 is connected with the constant voltage input terminal 1807, a voltage on a connection point 1810 coincides with that on the terminal 1807. When it is set so as to coincide a voltage on the terminal 1807 with a voltage on an opposite electrode used to apply a voltage to a liquid crystal and when the AC voltage as shown in FIG. 7A is applied, a voltage applied to the switches 1801 and 1802 can be half of an amplitude of the AC voltage, i.e. 7 V.

Figure 10:
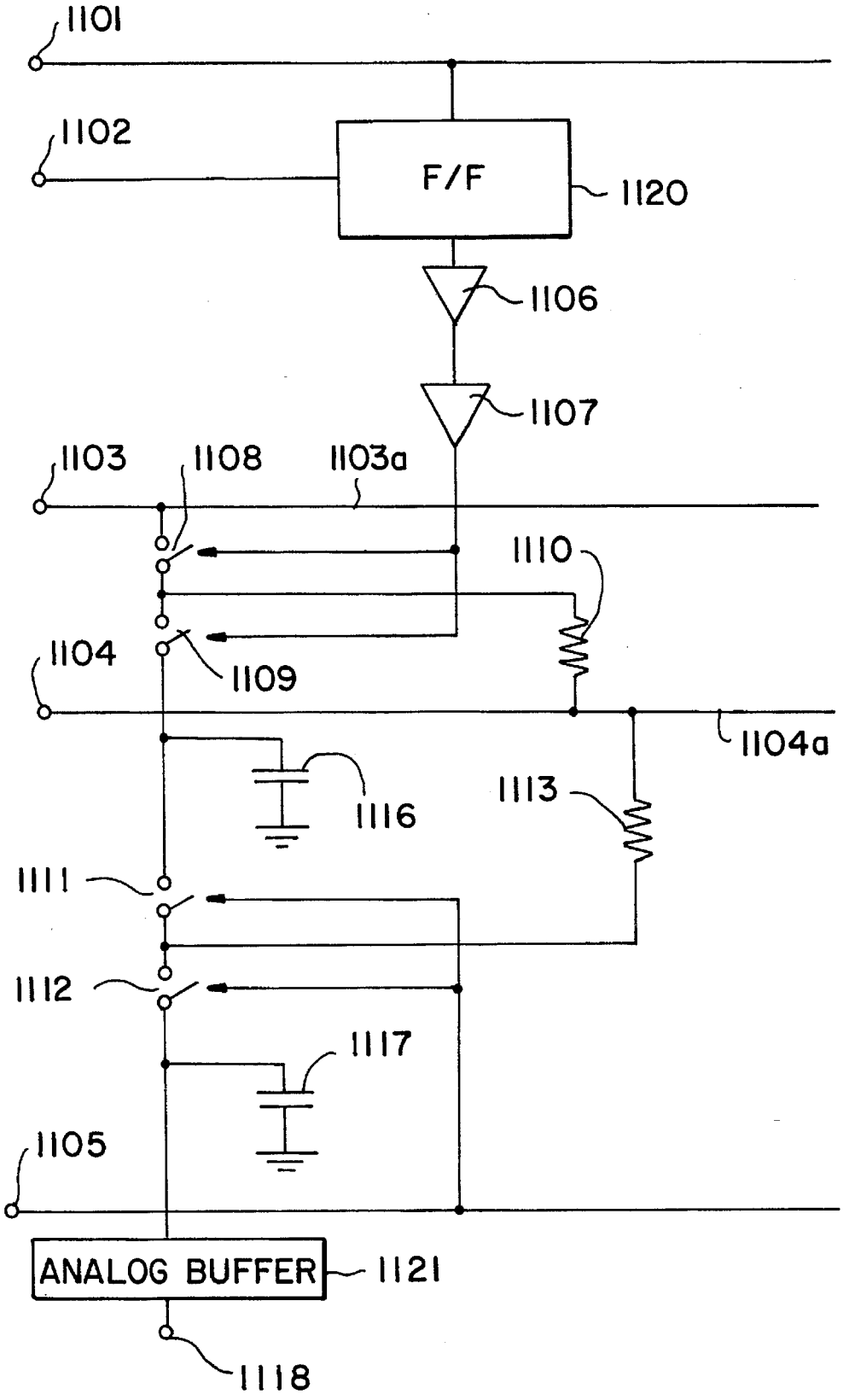
FIG. 10 shows a sapling circuit of a signal line driving circuit according to another embodiment of the present invention.

FIG. 10 shows an example of a sampling circuit of a signal line driving circuit according to another embodiment of the present invention. The sampling circuit includes a clock pulse signal input terminal 1101, a start pulse signal input terminal 1102, a video signal (gradation signal) input terminal 1103, a constant voltage input terminal 1104, transfer signal input terminal 1105, invertor type buffers 1106 and 1107, switches 1108, 1109, 1111 and 1112, resistors 1110 and 1113, storage capacitors 116 and 117, a signal line connection terminal 1118, a flip-flop (F/F) 1120, and an analog buffer 1121.

When sampling is performed, the switches 1108 and 1109 are turned on in accordance with output of the invertor type buffer 1107 and a voltage on the video signal (gradation signal) line 1103*a* is stored in the storage capacitor 1116. When sampling is not performed, the switches 108 and 109 are turned off. Since the resistor 1110 is connected with a constant voltage line 1104*a*, a voltage on a connection point connecting the switch 1108 with the switch 1109 coincides with that on the constant voltage line 104*a*. If a voltage on the line 104*a* is a voltage on an opposite electrode used to apply a voltage to a liquid crystal, the voltage applied to the switches 1108 and 1109 can be half of an amplitude of a video signal (gradation) on the video signal line 1103*a*. Also, a voltage applied to the switches 1111 and 1112 of the transfer circuit can be reduced.

Figure 12:
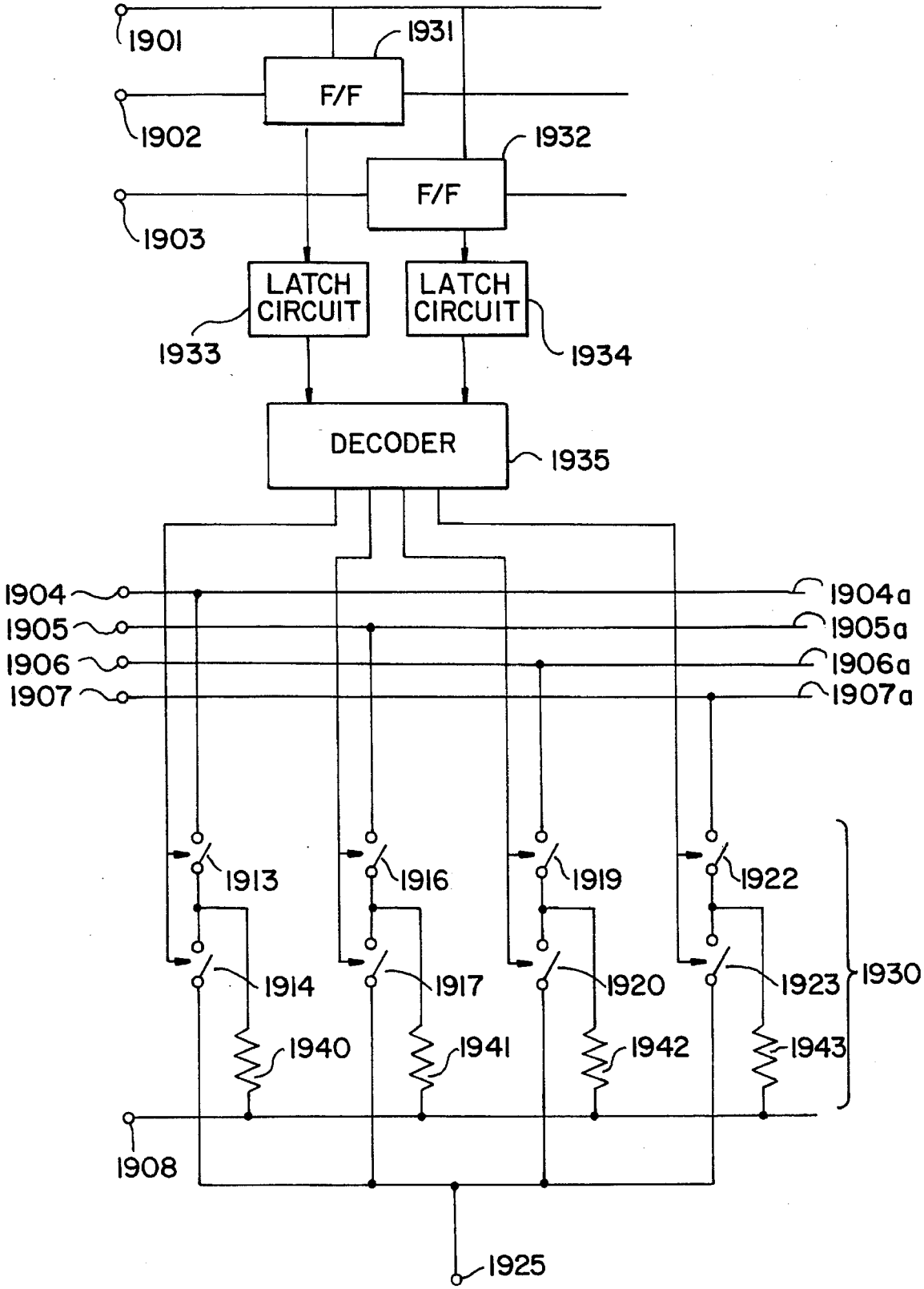
FIG. 12 shows a gradation voltage signal selecting circuit for a signal line driving circuit of 4 digital gradations according to another embodiment of the present invention.

FIG. 12 shows a gradation (voltage) signal selecting circuit for a signal line driving circuit of 4 digital gradations according to another embodiment of the present invention. The digital gradation type signal line driving circuit includes a clock pulse signal input terminal 1901, start pulse signal input terminals 1902 and 1903, gradation signal input terminal 1904 to 1907, gradation (voltage) signal lines 1904*a*, 1905*a*, 1906*a* and 1907*a*, a constant voltage input terminal 1908, a switching circuit 1930 constructed by switches 913, 1914, 1916, 1917, 1919, 1920, 1022 and 1923, a signal line output terminal 1925, flip-flops (F/Fs) 1931 and 1932, latch circuits 1933 and 1934, a decoder 1935, and resistors 1940 to 1943.

The switching circuit 930 selects one of the gradation signal lines 1904*a*, 1905*a*, 1906*a* and 1907*a* to connect the selected gradation signal line with the signal line output terminal 1925. When the gradation signal line 1904*a* is selected, the switches 1913 and 1914 are turned on and the switches 1916, 1917, 1919, 1920, 1922 and 1923 are turned off. If a voltage on the constant voltage input terminal 1908 is set to a desired voltage capable of supplying to the gradation voltage lines 904*a*, 905*a*, 906*a* and 907*a*, a voltage applied to each of the switches 1916, 1917, 1919, 1920, 1922 and 1923 can be reduced.

In the present invention, since a voltage applied to a TFT constructing a switch can be reduced and high withstanding voltage in the TFT is not required, the TFT can be operated at high speed.

What is claimed is:

1. A driving circuit for driving an active matrix circuit which is constructed by thin film transistors and has signal lines in a liquid crystal display device, the driving circuit comprising:

sampling means for sampling a gradation signal to be supplied to the signal line, wherein the sapling means comprises, a constant voltage terminal which a constant voltage is supplied to, a first switch which the gradation signal is supplied to, a second switch having two ends, wherein one end is connected with the first switch in series and the other end is connected with the signal line, and a third switch having two ends, wherein one end is connected with a connection point between the first and second switches and the other end is connected with the constant voltage terminal.

2. The circuit of claim 1 wherein the constant voltage is a voltage which can be supplied to the signal line.

3. The circuit of claim 1 wherein the first and second switches each has at least one thin film transistor.

4. The circuit of claim 1 wherein the third switch is turned on while the first and second switches are turned off.

5. A driving circuit for driving an active matrix circuit which is constructed by thin film transistors and has signal lines in a liquid crystal display device, the driving circuit comprising:

sampling means for sampling a gradation signal to be supplied to the signal line, wherein the sampling means comprises, a constant voltage terminal which a constant voltage is supplied to, a first switch which the gradation signal is supplied to, a second switch having two ends, wherein one end is connected with the first switch in series and the other end is connected with the signal line, and a resistor having both ends, wherein one end is connected with a connection point between the first and second switches and the other end is connected with the constant voltage terminal.

6. The circuit of claim 5 wherein the constant voltage is a voltage which can be supplied to the signal line.

7. The circuit of claim 5 wherein the first and second switches each has at least one thin film transistor.

8. The circuit of claim 5 wherein the third switch is turned on while the first and second switches are turned off.

9. A sampling circuit for a driving circuit for driving an active matrix circuit which is constructed by thin film transistors and has signal lines in a liquid crystal display device, the sampling circuit comprising:

a constant voltage terminal which a constant voltage is supplied to;

a first switch which a gradation signal is supplied to;

a second switch having two ends, wherein one end is connected with the first switch in series and the other end is connected with the signal line; and a third switch having two ends, wherein one end is connected with a connection point between the first and second switches and the other end is connected with the constant voltage terminal.

10. The circuit of claim 9 wherein the constant voltage is a voltage which can be supplied to the signal line.

11. The circuit of claim 9 wherein the first and second switches each has at least one thin film transistor.

12. The circuit of claim 9 wherein the third switch is turned on while the first and second switches are turned off.

13. A sampling circuit for a driving circuit for driving an active matrix circuit which is constructed by thin film transistors and has signal lines in a liquid crystal display device, the sampling circuit comprising:

a constant voltage terminal which a constant voltage is supplied to;

a first switch which a gradation signal is supplied to;

a second switch having two ends, wherein one end is connected with the first switch in series and the other end is connected with the signal line; and a resistor having two ends, wherein one end is connected with a connection point between the first and second switches and the other end is connected with the constant voltage terminal.

14. The circuit of claim 13 wherein a constant voltage is a voltage which can be supplied to the signal line.

15. The circuit of claim 13 wherein the first and second switches each has at least one thin film transistor.

16. The circuit of claim 13 wherein the third switch is turned on while the first and second switches are turned off.

17. A liquid crystal display device comprising:

an active matrix circuit which is constructed by thin film transistors and has signal lines; and driving means for driving the active matrix circuit, wherein the driving means includes, a constant voltage terminal which a constant voltage is supplied to, a first switch which a gradation signal is supplied to, a second switch having two ends, wherein one end is connected with the first switch in series and the other end is connected with the signal line, and a third switch having two ends, wherein one end is connected with a connection point between the first and second switches and the other end is connected with the constant voltage terminal.

18. The device of claim 17 wherein the constant voltage is a voltage which can be supplied to the signal line.

19. The device of claim 17 wherein the first and second switches each has at least one thin film transistor.

20. The device of claim 17 wherein the third switch is turned on while the first and second switches are turned off.

21. A liquid crystal display device comprising:

an active matrix circuit which is constructed by thin film transistors and has signal lines: and driving means for driving the active matrix circuit;

wherein the driving means includes, a constant voltage terminal which a constant voltage is supplied to, a first switch which a gradation signal is supplied to, a second switch having two ends, wherein one end is connected with the first switch in series and the other end is connected with the signal line, and a resistor having two ends, wherein one end is connected with a connection point between the first and second switches and the other end is connected with the constant voltage terminal.

22. The device of claim 21 wherein the constant voltage is a voltage which can be supplied to the signal line.

23. The device of claim 21 wherein the first and second switches each has at least one thin film transistor.

24. The device of claim 21 wherein the third switch is turned on while the first and second switches are turned off.

* * * * *